US008215116B2

(12) United States Patent
Fernandes et al.

(10) Patent No.: US 8,215,116 B2
(45) Date of Patent: Jul. 10, 2012

(54) SYSTEM AND METHOD FOR AIR-FUEL MIXING IN GAS TURBINES

(75) Inventors: Luiz C. V. Fernandes, Ottawa (CA); Elias Marquez, Queretaro (MX); Roy Marshall Washam, Clinton, SC (US)

(73) Assignee: General Electric Company, Schenectady, NY (US)

( * ) Notice: Subject to any disclaimer, the term of this patent is extended or adjusted under 35 U.S.C. 154(b) by 666 days.

(21) Appl. No.: 12/244,696

(22) Filed: Oct. 2, 2008

(65) Prior Publication Data

US 2010/0083663 A1 Apr. 8, 2010

(51) Int. Cl.
*F02C 1/00* (2006.01)

(52) U.S. Cl. ..... 60/772; 60/737; 60/740; 60/748

(58) Field of Classification Search ..... 60/737, 60/740, 748, 772
See application file for complete search history.

(56) References Cited

U.S. PATENT DOCUMENTS

| | | | | | |
|---|---|---|---|---|---|
| 3,808,803 | A * | 5/1974 | Salvi | 60/737 |
| 4,653,278 | A * | 3/1987 | Vinson et al. | 60/737 |
| 4,693,074 | A | 9/1987 | Pidcock et al. | |
| 5,165,241 | A * | 11/1992 | Joshi et al. | 60/737 |
| 5,319,935 | A * | 6/1994 | Toon et al. | 60/737 |
| 5,345,768 | A * | 9/1994 | Washam et al. | 60/737 |
| 5,373,693 | A * | 12/1994 | Zarzalis et al. | 60/748 |
| 5,540,056 | A * | 7/1996 | Heberling et al. | 60/737 |
| 5,603,211 | A * | 2/1997 | Graves | 60/776 |
| 5,896,739 | A * | 4/1999 | Snyder et al. | 60/737 |
| 5,941,075 | A | 8/1999 | Ansart et al. | |
| 6,094,916 | A * | 8/2000 | Puri et al. | 60/737 |
| 6,212,870 | B1 * | 4/2001 | Thompson et al. | 60/748 |
| 6,609,376 | B2 * | 8/2003 | Rokke | 60/737 |
| 6,799,427 | B2 * | 10/2004 | Calvez et al. | 60/737 |
| 6,935,116 | B2 * | 8/2005 | Stuttaford et al. | 60/737 |
| 7,065,972 | B2 | 6/2006 | Zupanc et al. | |
| 2005/0039456 | A1 * | 2/2005 | Hayashi | 60/737 |

* cited by examiner

*Primary Examiner* — Ehud Gartenberg
*Assistant Examiner* — Lorne Meade
(74) *Attorney, Agent, or Firm* — Fletcher Yoder P.C.

(57) ABSTRACT

A system includes a fuel nozzle for a turbine engine that includes a tapered central body located at an interior base of the fuel nozzle, an air swirler, and a fuel port in the tapered central body, separate from the air swirler.

29 Claims, 8 Drawing Sheets

SYSTEM AND METHOD FOR AIR-FUEL MIXING IN GAS TURBINES

BACKGROUND OF THE INVENTION

The present disclosure relates generally to a gas turbine engine and, more specifically, to a fuel nozzle with improved fuel-air mixing characteristics.

Gas turbine engines spin a turbine by producing pressurized gas that flows through the turbine. Pressurized gas is produced by burning a fuel such as propane, natural gas, kerosene or jet fuel, which is burned after being injected into a combustor or combustion chamber by a set of fuel nozzles. The mixing of fuel and gas by the fuel nozzles significantly affects engine performance and emissions. In particular, stricter emissions laws and increases in fuel prices make a lean pre-mix of gas and liquid fuel central to improvement of gas turbine performance.

BRIEF DESCRIPTION OF THE INVENTION

In one embodiment, the system includes a fuel nozzle for a turbine engine that includes a tapered central body located at an interior base of the fuel nozzle, an air swirler, and a fuel port in the tapered central body, separate from the air swirler. In another embodiment, the method includes injecting fuel from a bell shaped body at a base region of a fuel nozzle, swirling air in a cross flow direction with the fuel, and flowing the fuel and the air through a venturi chamber having a generally smooth curved surface.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION OF THE INVENTION

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

As discussed in detail below, various embodiments of fuel nozzle systems may be employed to improve the performance of a turbine engine system. In particular, an embodiment of a fuel nozzle includes a converging diverging venturi chamber, which includes smooth interior wall surfaces with small converging (less than 30 degrees) and diverging (less than 12 degrees) angles. Smooth surfaces in the venturi chamber can improve air fuel mixtures and reduce recirculation zones and/or mixing stagnation zones. The venturi's smooth inner surfaces generally have no sharp edges or angles, which, if present, may disrupt the flow across the nozzle and can lead to flow separation. In addition, improved air fuel mixtures will result in increased turbine performance and a reduction in emissions. Reduction of recirculation zones within a turbine system reduces the possibility of unwanted flame holding in the nozzle itself. For example, flame holding near a base of a fuel nozzle may cause unwanted radiation to components included in the base of the fuel nozzle. An embodiment also includes a radial swirler with air slots, which may be located along an interior nozzle wall at the base of the fuel nozzle. Moreover, a body may be attached to the center of the nozzle base, wherein the body has fuel inlet holes to enable a cross flow mixing between air coming from the swirler and fuel exiting the fuel inlet holes. As will be discussed further below, the disclosed embodiments of the fuel nozzle enable improved air fuel mixtures and eliminate or reduce flame holding near the bases or within the fuel nozzle body.

Figure 1:
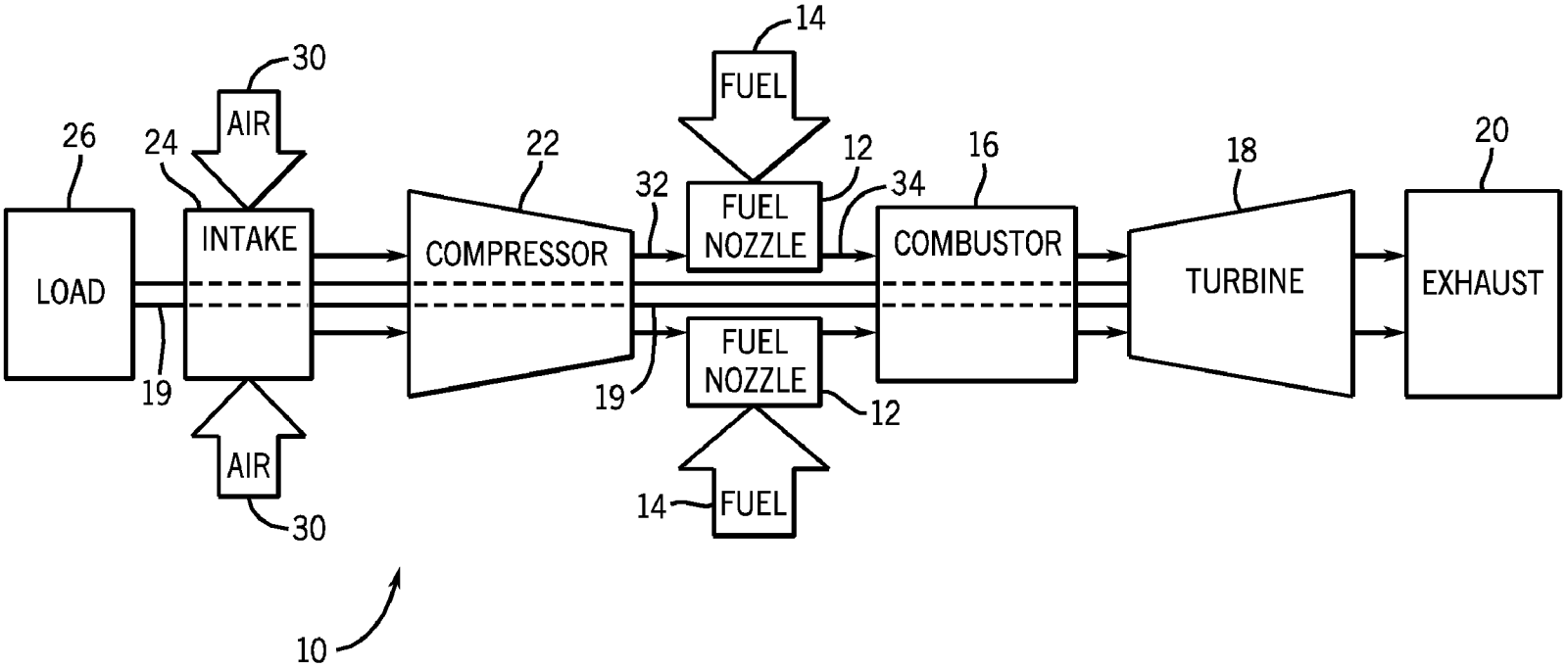
FIG. 1 is a block diagram of a turbine system having fuel nozzles coupled to a combustor in accordance with an embodiment of the present technique.

Turning now to the drawings and referring first to FIG. 1, a block diagram of an embodiment of a gas turbine system 10 is illustrated. The diagram includes fuel nozzle 12, fuel supply 14, and combustor 16. As depicted, fuel supply 14 routes a liquid fuel or gas fuel, such as natural gas, to the turbine system 10 through fuel nozzle 12 into combustor 16. As discussed below, the fuel nozzle 12 is configured to inject and mix the fuel with compressed air with an improved fuel-air mixture. The combustor 16 ignites and combusts the fuel-air mixture, and then passes hot pressurized exhaust gas into a turbine 18. The exhaust gas passes through turbine blades in the turbine 18, thereby driving the turbine 18 to rotate. In turn, the coupling between blades in turbine 18 and shaft 19 will cause the rotation of shaft 19, which is also coupled to several components throughout the turbine system 10, as illustrated. Eventually, the exhaust of the combustion process may exit the turbine system 10 via exhaust outlet 20.

In an embodiment of turbine system 10, compressor vanes or blades are included as components of compressor 22. Blades within compressor 22 may be coupled to shaft 19, and will rotate as shaft 19 is driven to rotate by turbine 18. Compressor 22 may intake air to turbine system 10 via air intake 24. Further, shaft 19 may be coupled to load 26, which may be powered via rotation of shaft 19. As appreciated, load 26 may be any suitable device that may generate power via the rotational output of turbine system 10, such as a power generation plant or an external mechanical load. For example, load 26 may include an electrical generator, a propeller of an airplane, and so forth. Air intake 24 draws air 30 into turbine system 10 via a suitable mechanism, such as a cold air intake, for subsequent mixture of air 30 with fuel supply 14 via fuel nozzle 12. As will be discussed in detail below, air 30 taken in by turbine system 10 may be fed and compressed into pressurized air by rotating blades within compressor 22. The pressurized air may then be fed into fuel nozzle 12, as shown by arrow 32. Fuel nozzle 12 may then mix the pressurized air and fuel, shown by numeral 34, to produce an optimal mix ratio for combustion, e.g., a combustion that causes the fuel to more completely burn, so as not to waste fuel or cause excess emissions. An embodiment of turbine system 10 includes certain structures and components within fuel nozzle 12 to improve the air fuel mixture, thereby increasing performance and reducing emissions.

Figure 2:
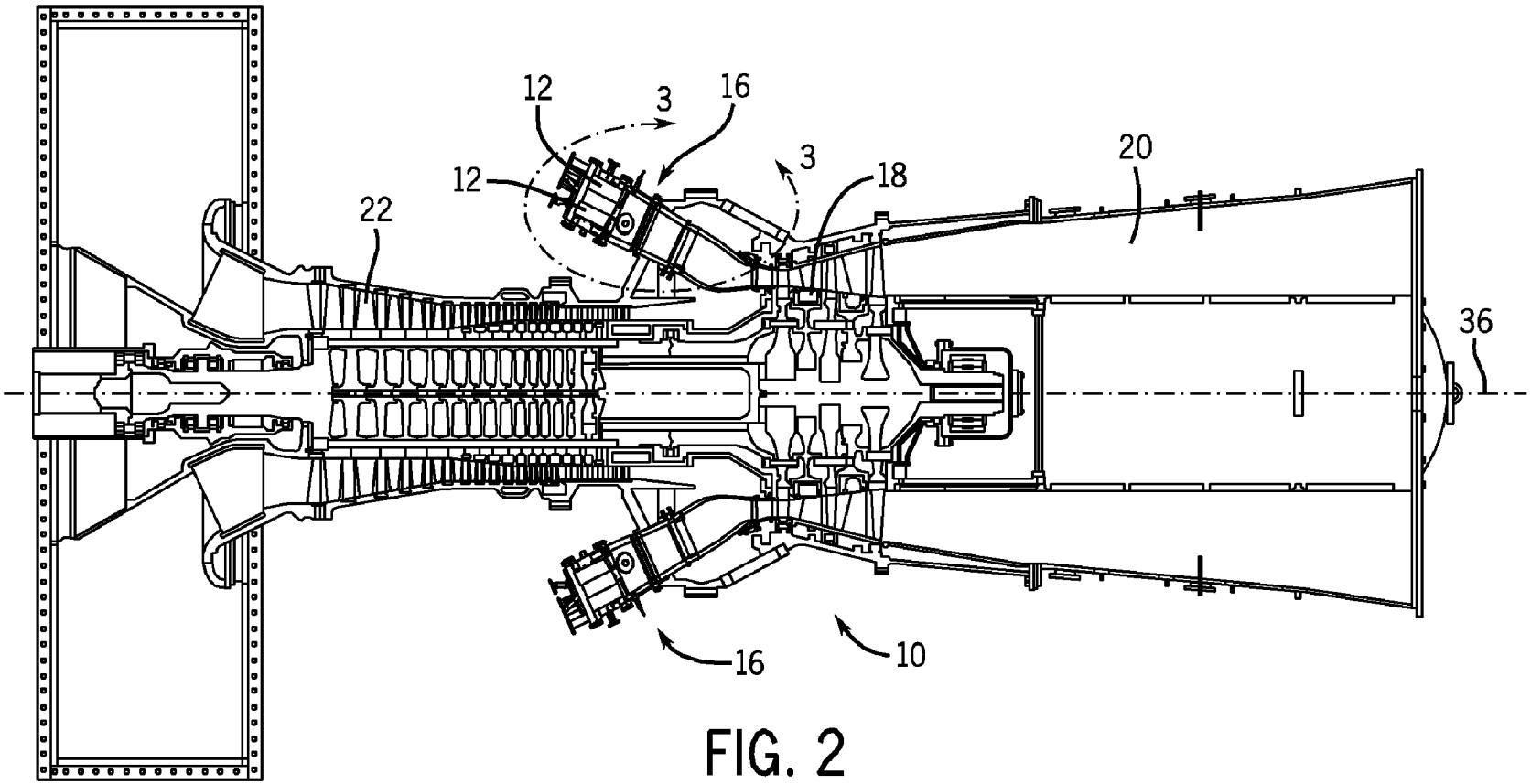
FIG. 2 is a cutaway side view of an embodiment of the turbine system, as shown in FIG. 1.

FIG. 2 shows a cutaway side view of an embodiment of turbine system 10. As depicted, the embodiment includes compressor 22, which is coupled to an annular array of combustors 16. For example, six combustors 16 are located in the illustrated turbine system 10. Each combustor 16 includes one or more fuel nozzles 12, which feed an air fuel mixture to a combustion zone located within each combustor 16. For example, each combustor 16 may include 1, 2, 3, 4, 5, 6, 7, 8, 9, 10, or more fuel nozzles 12 in an annular or other suitable arrangement. Combustion of the air fuel mixture within combustors 16 will cause vanes or blades within turbine 18 to rotate about axis 36 as exhaust gas passes toward exhaust outlet 20. As will be discussed in detail below, certain embodiments of fuel nozzle 12 include a variety of unique features to improve the air fuel mixture, thereby improving combustion, reducing undesirable exhaust emissions, and improving fuel consumption.

Figure 3:
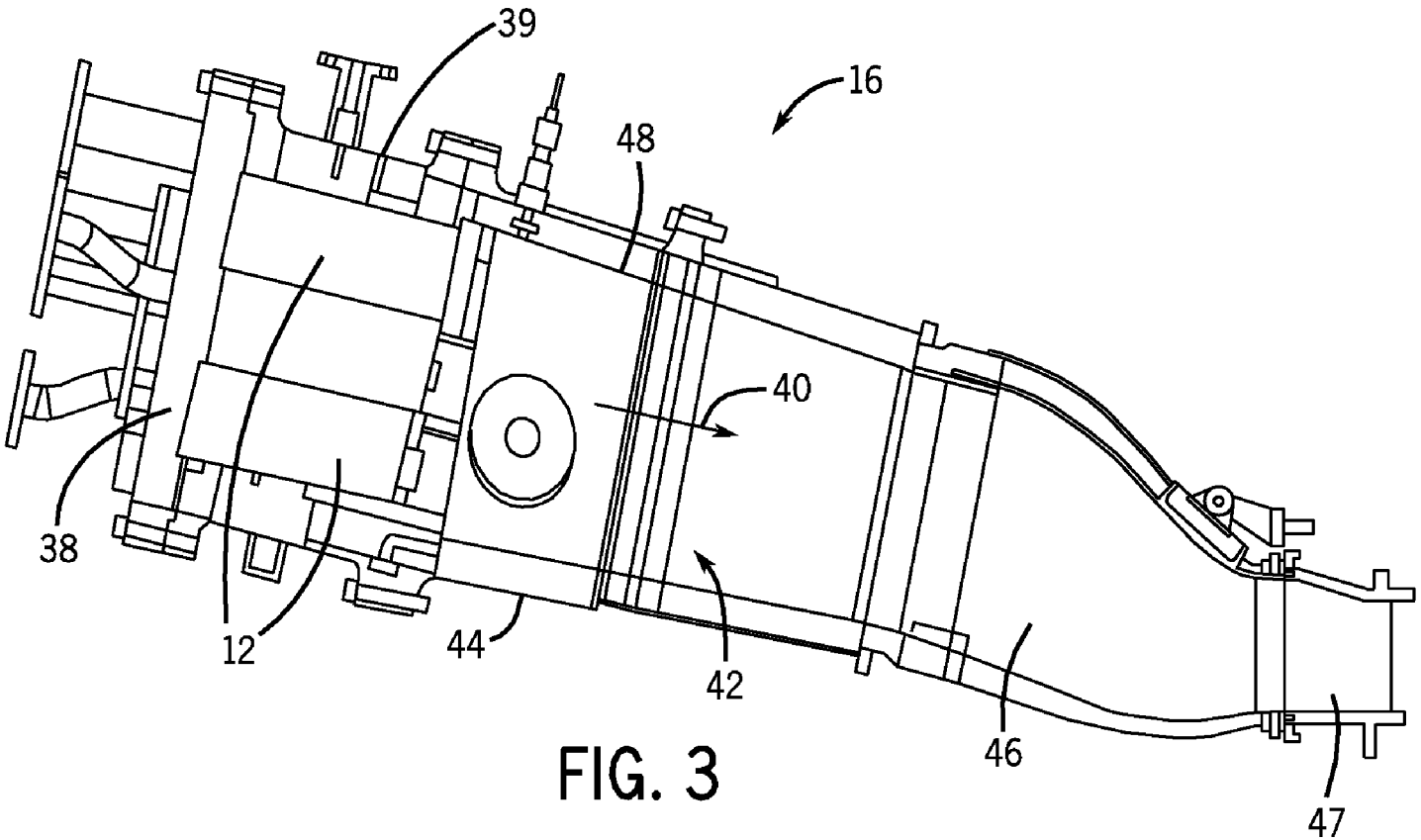
FIG. 3 is a cutaway side view of an embodiment of the combustor with fuel nozzles, as shown in FIGS. 1 and 2.

FIG. 3 is a detailed cutaway side view illustration of an embodiment of combustor 16. As depicted, combustor 16 includes fuel nozzles 12 that are attached to end cover 38 at a base 39 of combustor 16. A typical arrangement of combustor 16 may include five or six fuel nozzles 12. Other embodiments of combustor 16 may use a single large fuel nozzle 12. The surfaces and geometry of fuel nozzles 12 are designed to provide an optimal mixture and flow path for air and fuel as it flows downstream into combustor 16, thereby enabling increased combustion in the chamber, thus producing more power in the turbine engine. The fuel mixture is expelled from fuel nozzles 12 downstream in direction 40 to a combustion zone 42 inside combustor casing 44. Combustion zone 42 is the location where ignition of the air fuel mixture is most appropriate within combustor 16. For example, a flame holding or autoignition of the fuel upstream, near end cover 38, may result in combustion damage, possibly melting combustor hardware components. In addition, it is generally desirable to combust the air fuel mixture downstream of base 39 to reduce the heat transfer from the combustion zone 42 to the fuel nozzles 12. In the illustrated embodiment, combustion zone 42 is located inside combustor casing 44, downstream from fuel nozzles 12 and upstream from a transition piece 46, which directs the pressurized exhaust gas toward turbine 18 at outlet 47. Transition piece 46 includes a converging section that enables a pressure increase as the combusted exhaust flows out of combustor 16, producing a greater force to turn turbine 18. In turn, the exhaust gas causes rotation of shaft 19 to drive load 26. In an embodiment, combustor 16 also includes liner 48 located inside casing 44 to provide a hollow annular path for a cooling air flow, which cools the casing 44 around combustion zone 42. Liner 48 also may provide a suitable contour to improve flow from fuel nozzles 12 to turbine 18 at outlet 47.

Figure 4:
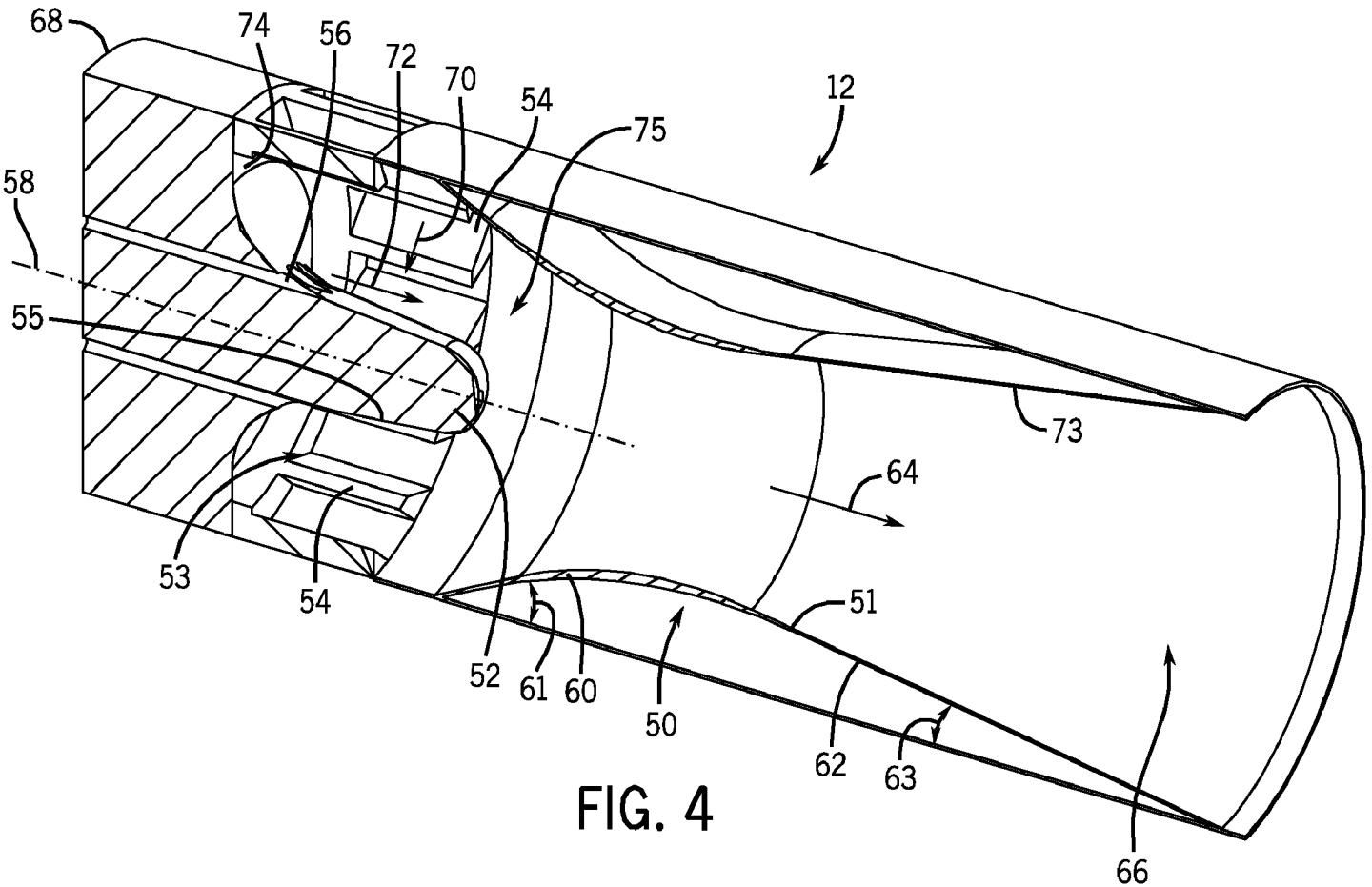
FIG. 4 is a sectional perspective view of a fuel nozzle having a venturi and a fuel distributing center body to improve fuel air mixing in accordance with certain embodiments of the present technique.

An embodiment of fuel nozzle 12 is shown in a sectional perspective view in FIG. 4. The illustration of fuel nozzle 12 includes venturi 50 with smooth surfaces 51 that include small converging and diverging angles. The venturi 50 enables an improved mixture of air and fuel within fuel nozzle 12. The elimination of sharp edges and angles from the interior surface leads to an improved flow and mixing of the air an fuel in fuel nozzle 12. In addition, a central body 52 may release fuel into fuel nozzle 12. Central body 52 is configured to create a hollow annular region 53 between swirler vanes 54 and smooth surfaces 55. As depicted, body 52 may be tapered and generally bell shaped, with smooth surfaces 55 and no sharp edges that can cause unwanted recirculation zones. The tapered bell shaped surface of body 52 may protrude into the nozzle, occupying a region where stagnation may occur in other designs. Stagnation is undesirable in a region as it can lead to an area where flow is not continuous downstream. The body 52 thereby eliminates stagnation via its placement within the upstream portion of fuel nozzle 12. Further, radial swirler vanes 54 may introduce air to be mixed with fuel that is emitted by fuel holes or ports 56 along smooth surfaces 55 of body 52. Venturi 50 includes converging section 60 as well as diverging section 62, which are designed to accelerate (converging section 60) the flow followed by flow deceleration (diverging section 62) of the air fuel mixture as it flows downstream in direction 64. In an embodiment, an angle 61 of converging section 60 relative to axis 58 may be less than 30 degrees, less than 20 degrees, or about 20-30 degrees. An angle 63 of diverging section 62 may be about 10 degrees, about 15 degrees, or less than about 10 degrees. In other embodiments, the angles 61 and 63 of converging section 60 and diverging section 62 may vary due to the length of venturi 50, properties of the fuel and/or air, shape of body 52, and other fuel nozzle parameters. As appreciated, the discussed angles are examples of many possible angles. Further, an important consideration when choosing the angles of venturi 50 is that the angles are determined in a way that the flow becomes attached all the time to the surfaces, thereby avoiding separation. The venturi 50, central body 52, and vanes 54 improve the air fuel mixture and pressure drop across fuel nozzle 12 to reduce recirculation zones within the nozzle 12, thereby causing flame occurrence at a desirable location downstream or near an end of nozzle 12, indicated by arrow 66. By reducing the possibility of ignition upstream, near annular region 53 and moving flame occurrences downstream near end region 66, components located near the nozzle base 68 avoid radiation caused by flames and high metal temperatures.

As appreciated, nozzle base 68 couples to end cover 38, thereby providing a seal and structural support between nozzle 12 and end cover 38. In an embodiment, the radial flow of air 70 through swirler vanes 54 may be transverse to, and intersect with, the fuel flow 72 of gaseous fuel. The crosswise flows of air and fuel 70 and 72 produce an optimal mixing arrangement within nozzle 12. Further, the design and smooth surfaces 51 and 55 of body 52 and venturi 50 reduce early flame generation near nozzle throat 75, reduce recirculation zones, and improve flow within nozzle 12. For example, the smooth surfaces 51 and 55 of body 52 and venturi 50 cause the air fuel mixture flow passing downstream 64 to attach to the interior walls of the nozzle 12. Moreover, the length of nozzle 50 in an axial 58 direction enables an enhanced mixture, due to the distance traveled before reaching nozzle end 66, where combustion will occur. In addition, annular region 53, central tapered body 52, and air swirler 54 provide an environment with smooth surfaces to enable smooth downstream flow while providing a crosswise intersection of air and fuel inputs to promote an improved mixture.

Figure 5:
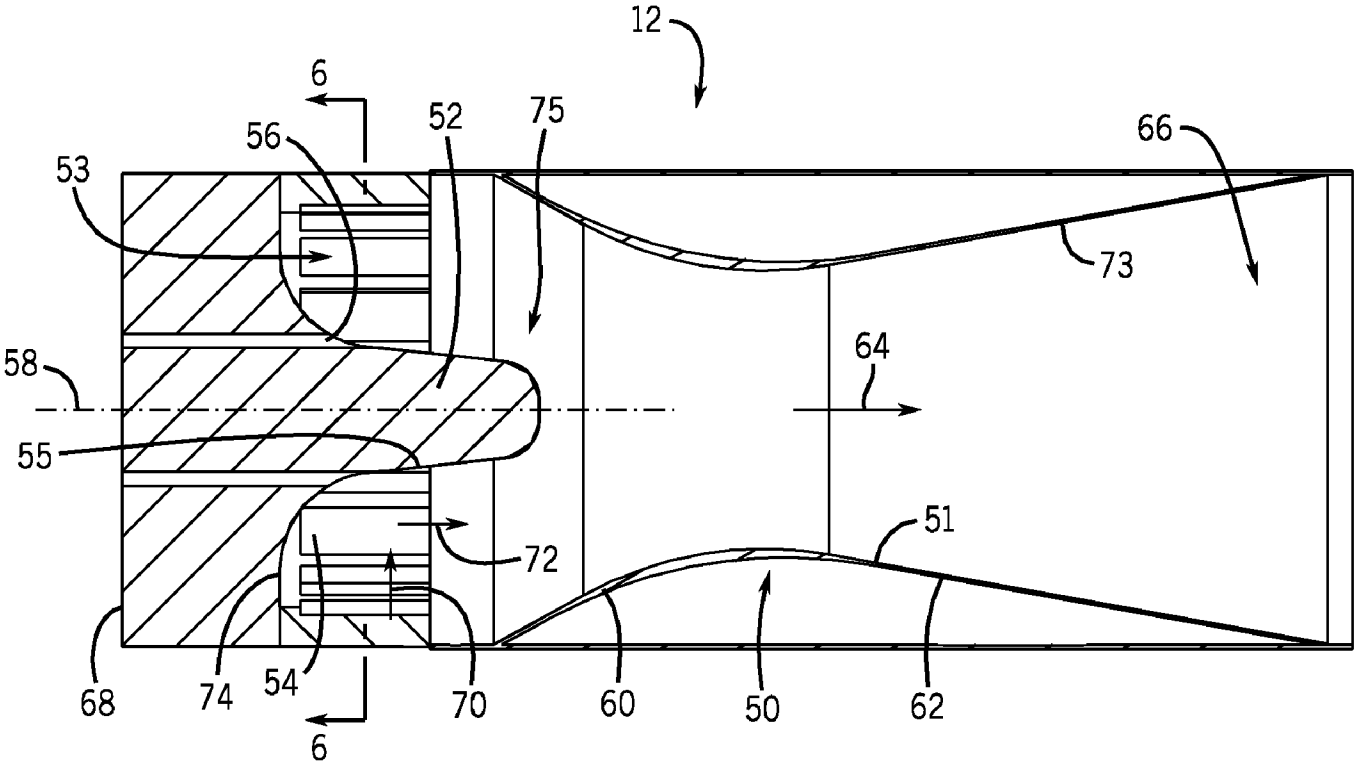
FIG. 5 is a cutaway side view of the fuel nozzle, as shown in FIG. 4, in accordance with an embodiment of the present technique.

FIG. 5 is a detailed side view of an embodiment of fuel nozzle 12. In the illustrated embodiment, fuel nozzle 12 includes converging section 60 and diverging section 62, which enable a reduced pressure drop throughout the length of fuel nozzle 12. Specifically, the geometry of sections 60 and 62 lead to reduced pressure losses near nozzle end 66. In an embodiment, converging section 60 is designed to suppress flow separation along body 52 that may stabilize a flame upstream of the nozzle throat 75. In other words, the converging section 60 is configured to prevent flame allocation, due to an air fuel mixture flow separation or stagnation, near body 52 and nozzle throat 75. In addition, divergent section 62 is designed to prevent flow separation downstream of the nozzle throat 75 near the nozzle walls 73, instead of in the center of nozzle end 66.

As discussed above, the smooth inner surfaces 51 of venturi 50 reduce the possibility of flame allocation before reaching nozzle end 66 by eliminating sharp edges and angles. Fuel is emitted from fuel holes 56 axially, shown by arrow 72, which mixes with air that enters nozzle 12 radially, shown by arrow 70. Swirl intake vanes 54 are designed to produce a swirling effect about axis 58 inside nozzle 12 as air enters nozzle 12 in direction 70. In other words, the angular orientation of swirl vanes 54 produce rotational air flow about nozzle axis 58 that enables an optimal air fuel mixture. For example, natural gas fuel may exit fuel holes or ports 56 in direction 72, where the fuel intersects air intake from direction 70, from angled swirl vanes 54. The crosswise intersected air and fuel may travel downstream, in direction 64, as the mixture swirls about axis 58, further mixing the air and fuel. The venturi 50 produces a reduced pressure drop as the mixed air and fuel ignite in nozzle end region 66. Fuel is released from fuel ports 56 in an area of low pressure zone generated by air flowing radially 70 from the swirler vanes 54.

Body 52 may be a protrusion from, or a separate component attached to, nozzle base 68. As shown, the gentle smooth slope from base surface 74 to surface 55 of body 52 generally biases or directs the flow in the downstream direction 64, thereby reducing the possibility of undesirable flame formation and holding near base surface 74, annular region 53, central body 52, and throat 75. For example, the fuel nozzle 12 changes the angle from about 90 degrees (i.e., perpendicular) to about 0 degrees (i.e., parallel) along the gentle smooth slope, such that the surfaces 55 of the central body 52 function as a gentle turn toward the axis 58 in the downstream direction 64. The design of body 52, which may be described as a bell shape, and the smooth converging 60 and diverging 62 regions of venturi 50 insure that flames will be located near the nozzle exit 66, far away from nozzle throat region 75. The location of a flame near nozzle end 66, instead of throat region 75, substantially reduces or prevents unwanted heating of metal surfaces within nozzle 12, such as body 52, which can lead to autoignition of unmixed fuel.

Figure 6:
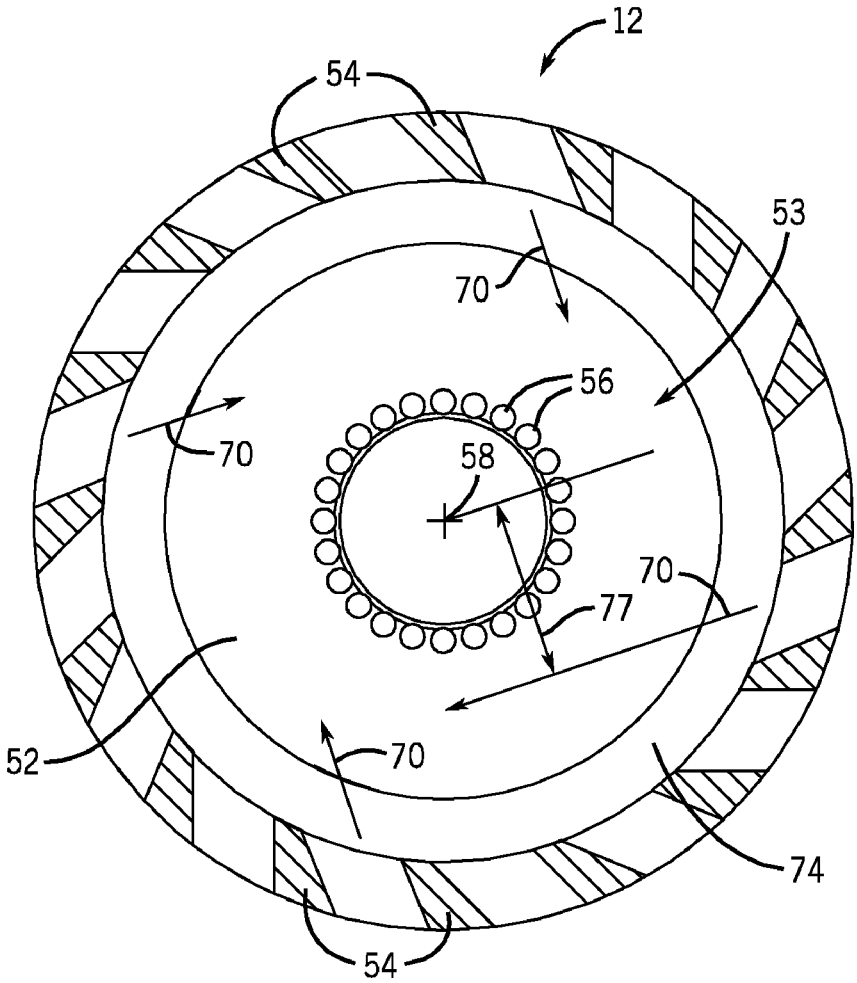
FIG. 6 is a cutaway end view of the fuel nozzle, as shown in FIG. 4, in accordance with an embodiment of the present technique.

FIG. 6 is an illustration of an embodiment of nozzle 12 shown in a sectional end view, looking upstream at the nozzle 12, as indicated by line 6-6 of FIG. 5. In an embodiment, nozzle 12 includes swirler vanes 54 configured to produce a swirling effect about nozzle axis 58 as air enters the nozzle 12 in direction 70. As illustrated, swirler vanes 54 extend radially inward toward but at an offset 77 from axis 58, such that the air-flow swirls in annular region 53 generally crosswise with fuel flows from fuel holes 56. An embodiment of nozzle 12 includes body 52 with bell shaped surface 55 having fuel holes 56, which release a gaseous fuel axially in a generally transverse direction to air intake direction 70. The swirling effect caused by swirler vanes 54 and the generally transverse arrangement of air intake 70 to gas intake 72 causes an improved air fuel mixture, thereby locating a flame in downstream direction 64 at nozzle end 66.

Figure 7:
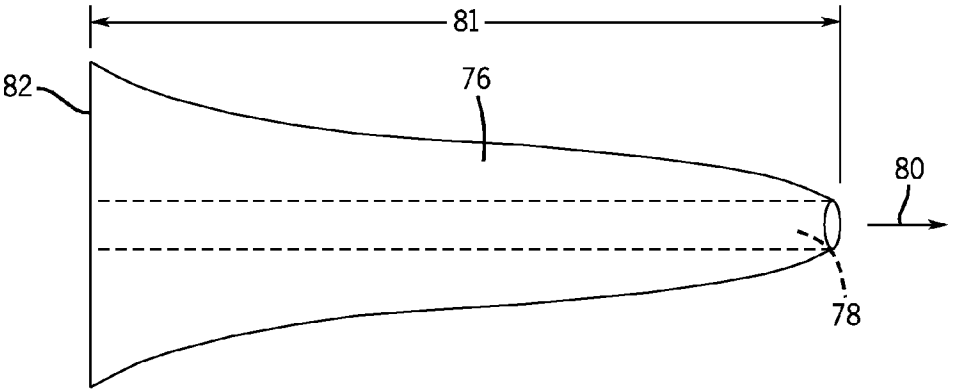
FIG. 7 is a side view of a nozzle center body, configured for distributing a liquid fuel, in accordance with an embodiment of the present technique.

FIG. 7 is an illustration of an embodiment of body 76, in a bell shaped arrangement, configured to release liquid fuel in nozzle 12. Body 76 may be used in some embodiments of nozzle 12, thereby replacing body 52 shown in FIGS. 4-6. Liquid fuel may be supplied to nozzle 12 and may be released into nozzle 12 via axial fuel hole 78. In some embodiments, there may be more than one axial fuel hole 78. As shown, center fuel hole 78 releases liquid fuel in an axial direction, indicated by arrow 80. Fuel hole or port 78 is offset distance 81 from body base surface 82. Body base surface 82 may be attached or otherwise coupled to nozzle base 68 at base surface 74 to define annular region 53 (see FIG. 5). In other embodiments, the shape of body 76 and location of hole 78 may vary due to the length of nozzle 12, properties of the fuel and/or air, shape of venturi 50, and other fuel nozzle parameters. For example, the body 76 may be a cone shape. As depicted, the flow of liquid fuel in direction 80 may be transverse to a swirling air flow 70 (see FIG. 4), thereby creating an optimal arrangement for an air fuel mixture. In addition, fuel does not mix with air until after (i.e., downstream of) body 76. In some embodiments, the air fuel mixture passes downstream in direction 64, across the entire length of fuel nozzle 12, before ignition of a flame located near nozzle end 66.

Figure 8:
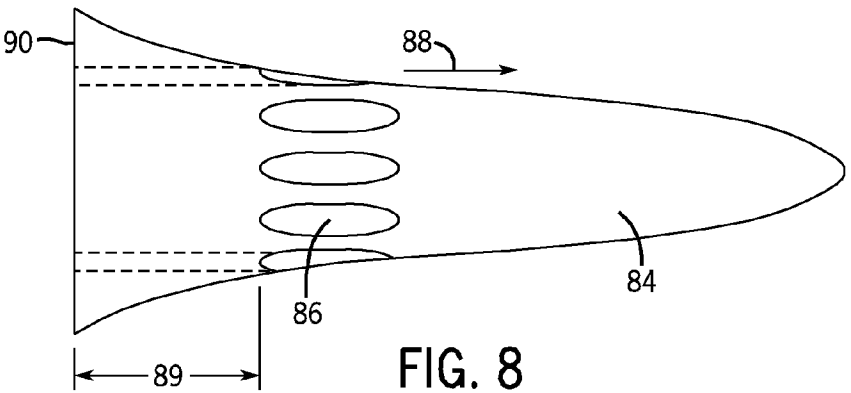
FIGS. 8 and 9 are side views of a nozzle center body, configured for distributing a liquid fuel, in accordance with other embodiments of the present technique.

FIG. 8 illustrates an embodiment of body 84, configured to distribute a gaseous fuel, such as natural gas, into fuel nozzle 12. Body 84 may be used in some embodiments of nozzle 12, thereby replacing body 52 shown in FIGS. 4-6. As shown, gaseous fuel may be released into fuel nozzle 12 via gas holes 86 in an axial direction, shown by arrow 88. Further, fuel holes or ports 86 are offset distance 89 from body base surface 90. As appreciated, the transverse orientation of fuel flow 88 to a swirling air flow 70 (see FIG. 4), causes an optimal arrangement for an air fuel mixture. Body 84 includes body base surface 90 which may be attached to nozzle base 68 at base surface 74 to define annular region 53 (See FIG. 5). The smooth surface and shape of bodies 76 and 84 shown in FIGS. 7 and 8, respectively, allow for fuel flow along the surface, reducing the possibility of autoignition or recirculation zones in the throat region 75 of nozzle 12. The fuel may mix with air along the surface of bodies 76 and 84, depending on the orientation of fuel ports 78 and 86, respectively. In addition, the tapered shape of bodies 76 and 84 may be more pointed away from base 82 or 90, respectively, or may be more blunt, depending on fuel type and other factors.

Figure 9:
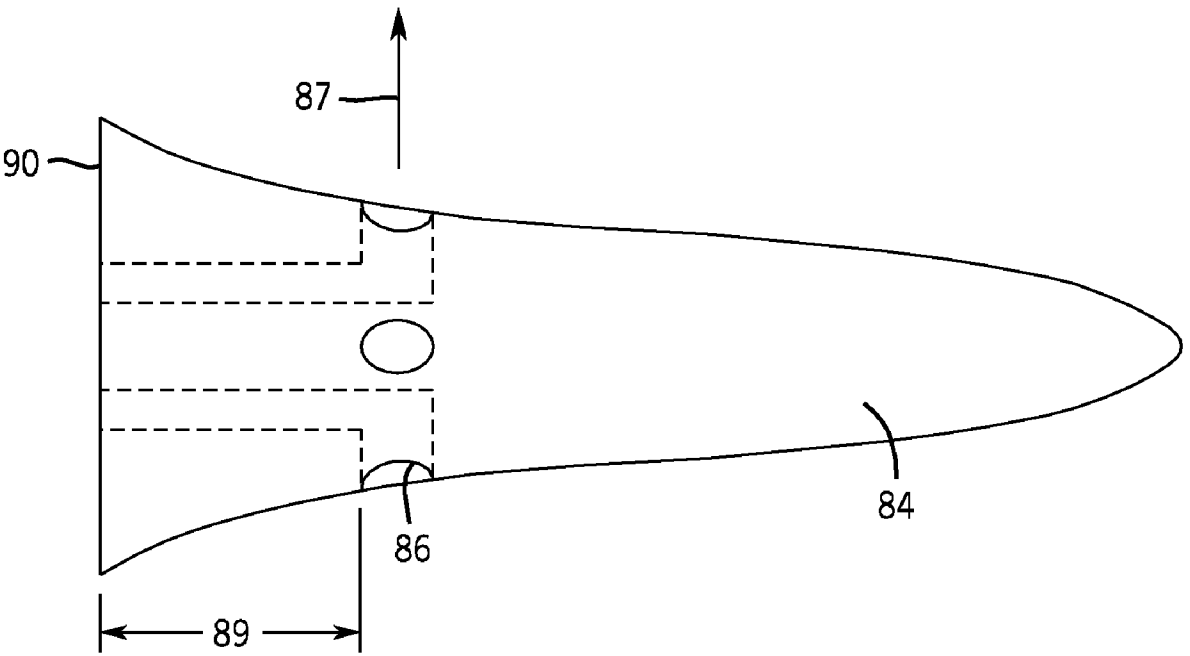

As appreciated, the design of body 52, 76, or 84, may be a bell shape, a cone shape, a tapered shape, a generally cylindrical shape with rounded edges, or any suitable smooth surface that will facilitate a smooth flow of an air fuel mixture. In other words, the design of body 52, located within nozzle 12, is used to reduce or eliminate stagnation zones, recirculation zones, and early flame allocation within nozzle 12. Moreover, the location of fuel holes 56 may be located in any suitable location within body 52 to produce an optimal intersection with air intake 70, thereby producing an optimal mixture. For example, one or more fuel holes may be disposed at base surface 74, offset along surfaces 55, at a downstream end of body 52, 76 or 84, or a combination thereof. In other embodiments, fuel holes 56 may cause fuel to be injected in nozzle 12 in a radial direction 87 (FIG. 9) instead of, or in addition to, an axial direction 88 (FIG. 8).

While only certain features of the disclosure have been illustrated and described herein, many modifications and changes will occur to those skilled in the art. It is, therefore, to be understood that the appended claims are intended to cover all such modifications and changes as fall within the true spirit of the disclosure.

The invention claimed is:

1. A system, comprising:

a fuel nozzle, comprising:

a tubular body portion with an inlet end portion and an outlet end portion;

a nozzle base portion having a tapered central body coaxial with the tubular body portion, wherein the nozzle base portion is disposed adjacent the inlet end portion of the tubular body portion, wherein an annular flow region is disposed between the tubular body portion and the tapered central body, wherein the tapered central body comprises an upstream end portion, a downstream end portion, an outer surface facing outwardly toward an inner surface of the tubular body portion between the upstream and downstream end portions, and a plurality of fuel ports disposed along the outer surface about a longitudinal axis of the fuel nozzle, wherein downstream corresponds to a direction of fluid flow from the inlet end portion toward the outlet end portion of the tubular body portion;

a radial air swirler coaxial with the tubular body portion, wherein the radial air swirler extends about the tapered central body, and the radial air swirler is disposed between the tubular body portion and nozzle base portion; and a converging diverging venturi chamber coaxial with and located inside the tubular body portion, wherein the converging diverging venturi chamber has a generally smooth curved surface, the converging diverging venturi chamber comprises a diverging section having a diverging angle and a converging section having a converging angle, the diverging angle does not exceed about 15 degrees along substantially an entire diverging length of the diverging section, the converging angle does not exceed about 30 degrees along substantially an entire converging length of the converging section, an entrance into the converging section is downstream of the radial air swirler, an exit from the diverging section extends toward the outlet end portion of the tubular body portion, and the radial air swirler has a first outer diameter that is less than or substantially equal to a second outer diameter of the inlet end portion of the tubular body portion.

2. The system of claim 1, wherein the tapered central body protrudes from an interior base surface of the fuel nozzle, and the plurality of fuel ports are disposed at an offset from the interior base surface.

3. The system of claim 1, wherein the radial air swirler is configured to swirl an air flow in a radially inward direction toward the plurality of fuel ports on the tapered central body.

4. The system of claim 1, wherein the tapered central body has a generally bell shaped exterior that curves along the outer surface and the downstream end portion, and the generally bell shaped exterior has a curvature that extends in a first direction inwardly toward the longitudinal axis, a second direction after the first direction that extends generally along the longitudinal axis, and a third direction after the second direction that extends inwardly toward the longitudinal axis at the downstream end portion.

5. The system of claim 1, wherein the radial air swirler comprises air slots in a circumferential arrangement along the tubular body portion about the tapered central body.

6. The system of claim 1, wherein the plurality of fuel ports have respective axes oriented crosswise to the longitudinal axis of the fuel nozzle.

7. The system of claim 1, wherein the plurality of fuel ports have respective axes oriented lengthwise along the longitudinal axis of the fuel nozzle.

8. The system of claim 1, wherein the fuel nozzle is configured to inject fuel only downstream from the radial air swirler, and the plurality of fuel ports are disposed downstream from the radial air swirler.

9. The system of claim 1, comprising a combustion chamber having the fuel nozzle.

10. The system of claim 9, comprising a compressor disposed upstream of the combustion chamber in an intake path to the combustor, a turbine disposed downstream of the combustion chamber in an exhaust path from the combustor, or a combination thereof.

11. The system of claim 1, wherein the outer surface of the tapered central body comprises a first curved surface that gradually increases in angle relative to the longitudinal axis in a downstream direction between the upstream and downstream end portions.

12. The system of claim 11, wherein the outer surface of the tapered central body comprises a second curved surface that gradually decreases in angle relative to the longitudinal axis in the downstream direction between the upstream and downstream end portions, and the second curved surface is disposed upstream from the first curved surface.

13. A fuel nozzle for a turbine engine, comprising:

tubular body, with an inlet end portion and an outlet end portion;

a tapered central body located at an interior base of the fuel nozzle, wherein the interior base is coaxial with and adjacent the inlet end portion of the tubular body, the tapered central body comprises a curved outer surface surrounding a longitudinal axis and facing outwardly toward an inner surface of the tubular body, and at least one fuel port disposed along the curved outer surface;

a radial air swirler configured to swirl an air flow in a radially inward direction toward the at least one fuel port on the tapered central body, wherein the radial air swirler is coaxial with and located between the interior base and the inlet end portion of the tubular body, the radial air swirler has a first outer diameter that generally does not exceed a second outer diameter of the inlet end portion of the tubular body, the fuel nozzle is configured to inject fuel only downstream from the radial air swirler, and the at least one fuel port is disposed downstream from the radial air swirler; and a converging diverging venturi chamber coaxial with and located inside the tubular body, wherein an entrance into the converging diverging venturi chamber is downstream of the radial air swirler, an exit from the converging diverging venturi chamber is disposed upstream or adjacent to the outlet end portion of the tubular body, and downstream corresponds to a direction of fluid flow from the inlet end portion toward the outlet end portion of the tubular body.

14. The fuel nozzle of claim 13, wherein the radial air swirler comprises air slots located along the inner surface of the tubular body adjacent to the interior base of the fuel nozzle.

15. The fuel nozzle of claim 13, wherein the curved outer surface of the tapered central body has a bell shaped curve that extends in a first direction inwardly toward the longitudinal axis, a second direction after the first direction that extends generally along the longitudinal axis, and a third direction after the second direction that extends inwardly toward the longitudinal axis at a downstream end portion of the tapered central body.

16. The fuel nozzle of claim 13, wherein the converging diverging venturi chamber has a curved converging portion and a curved diverging portion, wherein the curved converging portion has a converging angle that does not exceed about 30 degrees relative to the longitudinal axis along substantially an entire converging length of the curved converging portion, and the curved diverging portion comprises a diverging angle that does not exceed about 15 degrees relative to the longitudinal axis along substantially an entire diverging length of the curved diverging portion.

17. The fuel nozzle of claim 13, wherein the at least one fuel port is oriented in a radially outward direction relative to the longitudinal axis.

18. The fuel nozzle of claim 13, wherein the at least one fuel port is oriented in an axial direction along the longitudinal axis.

19. The fuel nozzle of claim 13, wherein the converging diverging venturi chamber has a maximum angle that does not exceed about 30 degrees along substantially an entire length of the converging diverging venturi chamber.

20. The fuel nozzle of claim 13, wherein the converging diverging venturi chamber has a diverging portion, a throat, and a converging portion, wherein the diverging portion is angled from an entry region to the throat, the converging portion is angled from the throat to an exit region, and the entry and exit regions have a substantially equal width.

21. A method of operating a turbine engine, comprising:

injecting fuel from at least one lateral fuel port in a bell shaped body disposed at a base region of a fuel nozzle, wherein the bell shaped body has a bell shaped exterior surface that curves from an upstream end portion to a downstream end portion in a first direction inwardly toward a longitudinal axis of the fuel nozzle, a second direction after the first direction that extends generally along the longitudinal axis, and a third direction after the second direction that extends inwardly toward the longitudinal axis at the downstream end portion;

flowing air through a tubular body from an inlet end portion to an outlet end portion, wherein the tubular body and the bell shaped body extend lengthwise along the longitudinal axis of the fuel nozzle, and the inlet end portion is adjacent the base region;

swirling the air, via a radial air swirler, in a cross flow direction with the fuel injected from the at least one lateral fuel port, wherein fuel is injected only downstream from the radial air swirler, the at least one lateral fuel port is disposed downstream from the radial air swirler, the radial air swirler is located between the base region and the inlet end portion of the tubular body, and the radial air swirler has a first outer diameter that is less than or substantially the same as a second outer diameter of the inlet end portion of the tubular body; and flowing the fuel and the air through a converging diverging venturi chamber downstream from the radial air swirler, wherein the converging diverging venturi chamber has a generally smooth curved surface, the converging diverging venturi chamber is disposed between the inlet end portion and the outlet end portion of the tubular body, and downstream corresponds to a direction of fluid flow from the inlet end portion toward the outlet end portion of the tubular body.

22. The method of claim 21, wherein swirling the air comprises injecting air into the fuel nozzle through air inlet vanes of the radial air swirler in directions radially toward but offset from the longitudinal axis of the fuel nozzle.

23. The method of claim 21, comprising reducing fuel mixing stagnation zones and flame holding within an interior of the fuel nozzle at least partially by the bell shaped body.

24. The method of claim 21, wherein the converging diverging venturi chamber has a maximum angle that does not exceed about 30 degrees along substantially an entire length of the converging diverging venturi chamber.

25. A system, comprising:

a fuel nozzle, comprising:

a base portion having a central body portion extending axially away from the base portion along a longitudinal axis of the fuel nozzle, wherein the central body portion comprises at least one fuel port;

an outer tubular portion extending lengthwise along the longitudinal axis of the fuel nozzle, wherein the outer tubular portion comprises a converging diverging venturi chamber between an inlet end portion and an outlet end portion of the outer tubular portion, and the converging diverging venturi chamber is disposed downstream from the central body portion relative to a direction of fluid flow through the fuel nozzle from the inlet end portion to the outlet end portion; and a radial air swirler disposed between the base portion and the inlet end portion of the outer tubular portion, wherein the radial air swirler extends circumferentially around the central body portion, and the radial air swirler has a first outer diameter that is less than or substantially the same as a second outer diameter of the inlet end portion of the outer tubular portion.

26. The system of claim 25, wherein the converging diverging venturi chamber has a maximum angle that does not exceed about 30 degrees along substantially an entire length of the converging diverging venturi chamber.

27. The system of claim 25, wherein the second outer diameter is substantially constant lengthwise along the outer tubular portion.

28. The system of claim 25, wherein the first outer diameter and the second outer diameter are substantially the same as one another.

29. The system of claim 25, comprising a turbine combustor or a turbine engine having the fuel nozzle.

* * * * *